US011999914B2

(12) United States Patent
Hima Bindu et al.

(10) Patent No.: US 11,999,914 B2
(45) Date of Patent: Jun. 4, 2024

(54) PROCESS AND A SYSTEM FOR PRODUCTION OF MULTIPLE GRADE DE-AROMATIZED SOLVENTS FROM HYDROCARBON STREAMS

(71) Applicant: INDIAN OIL CORPORATION LIMITED, Maharashtra (IN)

(72) Inventors: Vasamsetty Naga Veera Hima Bindu, Faridabad (IN); Mainak Sarkar, Faridabad (IN); Ganesh Vitthalrao Butley, Faridabad (IN); Ramesh Karumanchi, Faridabad (IN); Sarvesh Kumar, Faridabad (IN); Madhusudan Sau, Faridabad (IN); Gurpreet Singh Kapur, Faridabad (IN); Sankara Sri Venkata Ramakumar, Faridabad (IN)

(73) Assignee: INDIAN OIL CORPORATION LIMITED, Mumbai (IN)

( * ) Notice: Subject to any disclaimer, the term of this patent is extended or adjusted under 35 U.S.C. 154(b) by 0 days.

(21) Appl. No.: 17/481,077

(22) Filed: Sep. 21, 2021

(65) Prior Publication Data

US 2022/0089960 A1 Mar. 24, 2022

(30) Foreign Application Priority Data

Sep. 21, 2020 (IN) ..... 202021040820

(51) Int. Cl.
*C10G 67/06* (2006.01)
*C10G 7/00* (2006.01)
(Continued)

(52) U.S. Cl.
CPC ..... *C10G 67/14* (2013.01); *C10G 7/00* (2013.01); *C10G 25/00* (2013.01); *C10G 31/00* (2013.01);
(Continued)

(58) Field of Classification Search
CPC ..... C10G 67/00; C10G 67/02; C10G 67/06; C10G 67/14; C10G 7/00; C10G 25/00;
(Continued)

(56) References Cited

U.S. PATENT DOCUMENTS 3,481,996 A * 12/1969 Kirk, Jr. ..... C10G 65/08 585/254
3,859,203 A * 1/1975 Brunn ..... C10G 49/007 208/216 PP
(Continued)

FOREIGN PATENT DOCUMENTS

WO WO-0181507 A1 * 11/2001 ..... C10G 65/08

*Primary Examiner* — Michelle Stein
(74) *Attorney, Agent, or Firm* — Maschoff Brennan

(57) ABSTRACT

A process and a system are used for production of multiple grades of ultralow aromatic solvents/chemicals having preferred boiling range, flash point and viscosity from different hydrocarbon streams. A plurality of hydrotreating steps are used to hydrotreat a plurality of hydrocarbon feedstocks in the presence of a hydrogen gas stream and a catalyst system. Further, at least one dissolved gas stripping step, at least one adsorption step, and a distillation step are included in the process. Desired iso-paraffin molecules are thereby preserved, and the undesired aromatic molecules are converted into desired naphthene molecules.

8 Claims, 2 Drawing Sheets

(51) Int. Cl.

| | |
|---|---|
| ***C10G 25/00*** | (2006.01) |
| ***C10G 31/00*** | (2006.01) |
| ***C10G 45/08*** | (2006.01) |
| ***C10G 45/50*** | (2006.01) |
| ***C10G 67/14*** | (2006.01) |

(52) U.S. Cl.
CPC ..... *C10G 45/08* (2013.01); *C10G 45/50* (2013.01); *C10G 67/06* (2013.01); *C10G 2300/1037* (2013.01); *C10G 2300/202* (2013.01); *C10G 2300/207* (2013.01); *C10G 2300/302* (2013.01); *C10G 2300/308* (2013.01); *C10G 2300/4006* (2013.01); *C10G 2300/4012* (2013.01); *C10G 2300/4018* (2013.01); *C10G 2300/80* (2013.01); *C10G 2400/30* (2013.01)

(58) Field of Classification Search
CPC ..... C10G 25/03; C10G 25/12; C10G 31/00; C10G 45/08; C10G 45/50; C10G 45/06; C10G 2300/1037; C10G 2300/202; C10G 2300/207; C10G 2300/302; C10G 2300/308; C10G 2300/4006; C10G 2300/4012; C10G 2300/4018; C10G 2300/80; C10G 2300/30
See application file for complete search history.

(56) References Cited

U.S. PATENT DOCUMENTS

| | | | | | |
|---|---|---|---|---|---|
| 4,469,590 | A * | 9/1984 | Schucker | B01J 23/687 585/277 |
| 4,875,992 | A * | 10/1989 | Hamner | C10G 45/52 208/89 |
| 5,294,334 | A * | 3/1994 | Kaul | C10G 25/03 502/514 |
| 5,391,291 | A * | 2/1995 | Winquist | C10G 45/54 208/143 |
| 5,454,933 | A * | 10/1995 | Savage | C10G 67/06 208/299 |
| 5,520,799 | A * | 5/1996 | Brown | C10G 45/10 208/143 |
| 5,928,497 | A * | 7/1999 | Iaccino | C10G 67/06 208/212 |
| 5,928,498 | A * | 7/1999 | McVicker | C10G 45/62 208/213 |
| 7,575,668 | B1 * | 8/2009 | Nafis | C10G 47/14 208/57 |
| 8,114,273 | B2 | 2/2012 | Touffait et al. | |
| 8,545,694 | B2 | 10/2013 | McCarthy et al. | |
| 8,968,552 | B2 | 3/2015 | Ramaseshan et al. | |
| 2003/0062292 | A1 * | 4/2003 | Hantzer | C10G 45/12 208/213 |
| 2008/0105595 | A1 * | 5/2008 | Koseoglu | C10G 55/06 208/91 |
| 2013/0109895 | A1 * | 5/2013 | Novak | C10G 67/06 208/246 |
| 2013/0270155 | A1 * | 10/2013 | Kumar | C10G 25/00 208/212 |
| 2019/0048270 | A1 * | 2/2019 | Vannauker | C10G 65/08 |
| 2019/0264116 | A1 * | 8/2019 | Gunther | C10G 67/049 |

* cited by examiner

PROCESS AND A SYSTEM FOR PRODUCTION OF MULTIPLE GRADE DE-AROMATIZED SOLVENTS FROM HYDROCARBON STREAMS

FIELD OF THE INVENTION

The present invention relates to a process and a system for production of multiple grades of ultra-low aromatic solvents/chemicals having preferred boiling range, flash point and viscosity from different hydrocarbon streams.

BACKGROUND OF THE INVENTION

Applications of hydrocarbon streams as solvents are increasing day by day. These solvents find wide range of day-to-day applications in paint, decorative coatings, rust preventive fluids, metal working fluids, drilling fluids, inks, silicone sealants, solvent for resins, chilling fluids, viscosity depressants, extender oils in adhesives, cutting fluids, electric discharge machining, aluminum rolling oils, crop protection fluids, etc. In addition, these solvents also find high-end applications such as cosmetic, pharmaceutical, food processing and industrial lubricants such as gear oils, turbine oils, textile oils, insulation oils, and transmission fluids.

With increasing environmental and health concerns, regulations are being imposed by many countries regarding the aromatic concentration in the solvents being used for the above-mentioned applications.

Some of the prior known technologies discuss about the production of high-quality distillates and lower molecular weight products from the high aromatic hydrocarbons.

U.S. Pat. No. 8,968,552B2 discloses integrated hydrotreating and aromatic saturation systems and method for efficient production of high-quality distillates from high sulfur, high aromatic hydrocarbons at existing or new hydrocracking facilities. The integrated process increases the overall catalytic activity and hydrogenation capability to produce superior distillate products. An intermediate hydrogen separation and purification system is integrated with a hydrotreating and an aromatic saturation process for the production of relatively lower molecular weight products from a relatively heavy feedstock including sulfur-containing and aromatic-containing hydrocarbon compounds. The integrated process allows the processing of heavy hydrocarbon feedstock having high aromatic and high sulfur contents in a single-stage configuration and the using of noble metal catalyst in the aromatic saturation zone. The integrated process increases the overall catalytic activity and hydrogenation capability to produce superior distillate products.

U.S. Pat. No. 8,114,273B2 discloses an improved hydrotreating process for removing sulfur from distillate boiling range feed streams. This improved process utilizes a two stage hydrotreating process scheme, each stage associated with an acid gas removal zone wherein one of the stages utilizes a rapid cycle pressure swing adsorption zone to increase the concentration of hydrogen in the process.

U.S. Pat. No. 8,545,694B2 discloses an improved aromatics saturation process for use with lube oil boiling range feed streams utilizing a catalyst comprising a hydrogenation-dehydrogenation component selected from the Group VIII noble metals and mixtures thereof on a mesoporous support having aluminum incorporated into its framework and an average pore diameter of about 15 to less than about 40 Å.

The known technologies discuss about the aromatic saturation process. However, lowering aromatic content lowers the solvency effect of the solvents. It is also observed that increasing the paraffinic content beyond certain limit, also affects the solvency as well as other properties. Further, the solvency of any solvent mainly depends on the dispersive forces and these forces are higher in aromatics due to high electron density. The dispersive forces are higher in naphthenes compared to paraffins, due to high electron density of the former. Naphthene is saturated and creates less environmental and health issues compared to aromatics.

Further, it is also observed that isoparaffinic-rich solvent properties are comparable with naphthenic-rich solvents. They have high solvency power, high interfacial tension, low electrical conductivity, etc. The isoparaffinic content can replace the effects caused due to low aromatic content and make the solvent more compatible for high-end applications.

In addition to above, good emulsion stability, good low temperature properties, low viscosity index, higher volatility, higher heat transfer capacity and large viscosity range makes the naphthenic-rich solvents more preferable over paraffin-rich solvents. Also, the thickener consumption is less due to high solvency power and proper consistency is maintained in many high-end products.

Accordingly, there is a need for an integrated process for producing ultra-low aromatic chemicals from different types of hydrocarbon streams, wherein, the process preserves the desired iso-paraffin molecules, and covert the undesired aromatic molecules into desired naphthene molecules.

SUMMARY OF THE PRESENT INVENTION

The present invention relates to a process for producing a plurality of ultra-low aromatic chemicals from a plurality of hydrocarbon streams. Wherein, the ultra-low aromatic chemicals have predefined boiling temperature ranges, flash point and viscosity, wherein, the ultra-low aromatic chemicals are produced from different hydrocarbon streams comprising plurality of hydrotreating and adsorption steps along with other processing steps such as at least one dissolved gas stripping step, and a fractional distillation step.

The process for producing a plurality of ultra-low aromatic chemicals from a plurality of hydrocarbon streams includes a plurality of hydrotreating steps to hydrotreat a plurality of hydrocarbon feedstocks in the presence of a hydrogen gas stream and a catalyst system, wherein, the plurality of hydrotreating steps preserve the desired iso-paraffin molecules, and covert the undesired aromatic molecules into desired naphthene molecules.

Further, the process also includes at least one dissolved gas stripping step to remove at least one dissolved gas (5) from the hydrotreated hydrocarbon feedstock. At least one adsorption step for a selective adsorption, or a selective desorption of at least one molecule from the hydrotreated hydrocarbon feedstock, wherein, the selective adsorption is based on the difference in polarity of the molecules of the hydrotreated hydrocarbon feedstock. A distillation step for separating out the plurality of ultra-low aromatic chemicals from the hydrotreated hydrocarbon feedstock obtained after at least one adsorption step.

The system for producing multiple grades of ultra-low aromatic chemicals from a plurality of hydrocarbon streams includes at least two reactor units (A, C) for hydrotreating a plurality of hydrocarbon feedstocks in the presence of a hydrogen gas stream and a hydrotreating catalyst system. The system further includes at least one stripper unit (B) placed in between the at least two reactor units (A, C) for stripping out at least one dissolved gas from the hydrotreated hydrocarbon feedstocks. Further, the system also includes at least one adsorption unit (D) for a selective adsorption, or a selective desorption of at least one molecule from the hydrotreated hydrocarbon feedstock, wherein, a temperature for the selective adsorption is between 35-120° C., and a temperature for the selective desorption is 200-300° C. The system further includes at least one distillation unit (E) for fractional distillation of the hydrotreated hydrocarbon feedstocks.

Technical Advantages of the Invention

The present invention provides technical advantages over the prior arts. The present invention facilitates the production of different grade specialty solvents/chemicals in a single system configuration.

The present invention also facilitates utilization of different low value streams of a refinery to obtain multiple grades of high value de-aromatized specialty solvents/chemicals.

Further, it is also observed that substantial amount of lighter hydrocarbon fractions is generated due to deep desulfurization and de-aromatization reactions especially, during production of de-aromatized solvents/chemicals from hydrocarbon streams. It is also observed that these lighter factions have very limited use as specialty solvent/chemicals in the industries and the present invention provides a process and system for converting these low value lighter fractions into high value specialty solvents.

The present invention also discloses segregation of reaction zones and operating conditions based on the molecular composition. Wherein, the segregation of reaction zones and operating conditions preserves the identity of desired molecules (iso-paraffin) as required for specialty solvent/chemical, and at the same time the undesired molecules (aromatics) are converted into desired molecules (naphthene).

Further, in the present invention the integration of hydrotreating and adsorption process has been done in a synergic manner to obtain multiple grades of specialty products. Because of synergic integration of different process and feed stream, the pressure has been optimized and it is lower.

Objectives of the Present Invention

It is a primary objective of the invention which relates to the production of multiple grades of de-aromatized solvents of different boiling range, flash point and viscosity from a single complex.

It is the further objective of the present invention to provides a process which generates low value lighter fractions by doping nitrogen compound in the feed.

Further the object of this invention is that it covers the process wherein the different low value streams (e.g., hydrocracker naphtha) of refinery are converted into high value specialty products.

Further, the main objective of the present invention is a process and a system for producing a plurality of ultra-low aromatic chemicals from a plurality of low value hydrocarbon streams.

BRIEF DESCRIPTION OF THE DRAWING

To further clarify advantages and aspects of the invention, a more particular description of the invention will be rendered by reference to specific embodiments thereof, which is illustrated in the appended drawing(s). It is appreciated that the drawing(s) of the present invention depicts only typical embodiments of the invention and are therefore not to be considered limiting of its scope.

DESCRIPTION OF THE INVENTION

Figure 1:
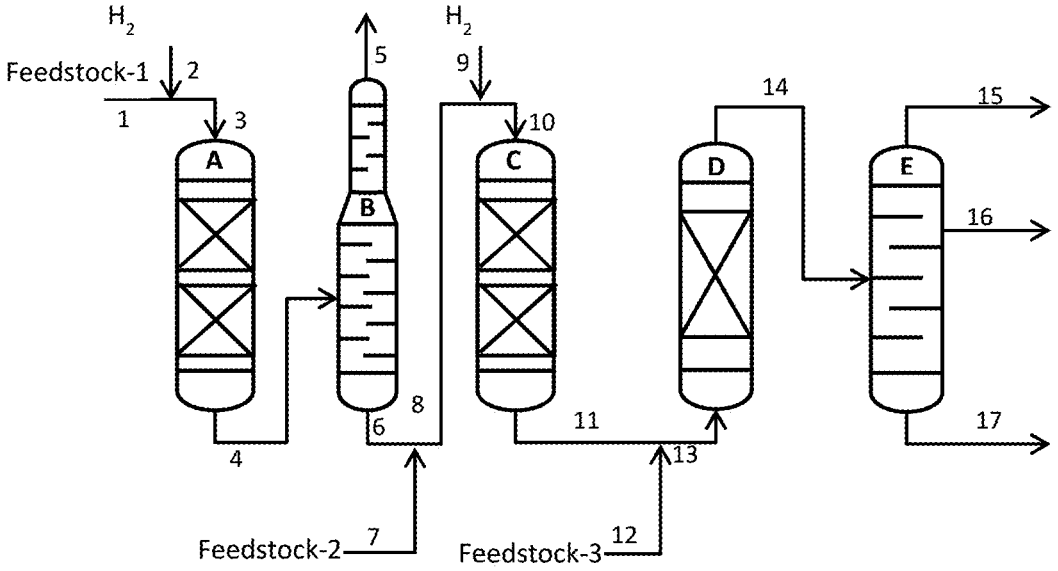
FIG. 1: illustrates a schematic process flow diagram of the invented process.
Figure 2:
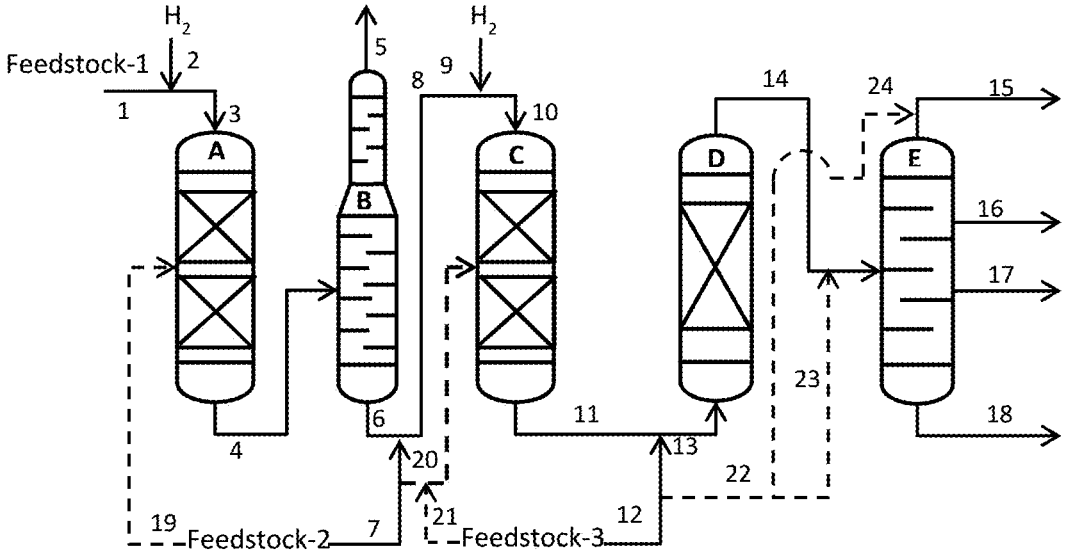
FIG. 2: illustrates an embodiment of the invented process.

For promoting an understanding of the principles of the present disclosure, reference will now be made to the specific embodiments of the present invention further illustrated in the drawings and specific language will be used to describe the same. The foregoing general description and the following detailed description are explanatory of the present disclosure and are not intended to be restrictive thereof. It will nevertheless be understood that no limitation of the scope of the present disclosure is thereby intended, such alterations and further modifications in the illustrated composition, and such further applications of the principles of the present disclosure as illustrated herein being contemplated as would normally occur to one skilled in the art to which the present disclosure relates. Unless otherwise defined, all technical and scientific terms used herein have the same meaning as commonly understood by one of ordinarily skilled in the art to which this present disclosure belongs. The methods, and examples provided herein are illustrative only and not intended to be limiting.

The present invention discloses a process and a system for producing a plurality of ultra-low aromatic chemicals from a plurality of low value hydrocarbon streams. The process for producing a plurality of ultra-low aromatic chemicals from a plurality of low value hydrocarbon streams includes a first hydrotreating step performed on a hydrocarbon feedstock-1 (1) doped with 50-500 ppmw of a nitrogen compound in a first reactor unit (A), wherein, the first reactor unit (A) is loaded with a dual functional catalyst system having desulfurization and hydrogenation properties to provide a first effluent (4).

Further, the process also includes at least one dissolved gas stripping step performed in at least one stripper unit (B) to remove at least one dissolved gas (5) from the first effluent (4), wherein, the dissolved gas stripping step provides a stripper effluent (6). At least one adsorption step for a selective adsorption, or a selective desorption of at least one molecule from the second effluent (11), wherein, the selective adsorption is based on the difference in polarity of the molecules to result in an effluent (14). A distillation step for separating out the plurality of ultra-low aromatic chemicals from the effluent (14).

Further, the process includes a second hydrotreating step performed on a hydrocarbon feedstock-2 (7) in a second reactor unit (C), wherein, the second reactor unit (C) is loaded with a hydrogenation catalyst system having aromatic saturation properties to provide a second effluent (11). Wherein, the first hydrotreating step, the second hydrotreating step both differ in operating conditions, hydrotreating catalyst system, and hydrocarbon feedstocks. Further, the first hydrotreating step, the second hydrotreating step both preserves the desired iso-paraffin molecules and convert the undesired aromatic molecules into desired naphthene molecules. Hereinafter, the first reactor unit (A) is referred as "Reactor-1" and the second reactor unit (C) is referred as "Reactor-2".

Further, the process includes at least one adsorption step for a selective adsorption, or a selective desorption of at least one molecule from the second effluent (11), wherein, the selective adsorption is based on the difference in polarity of the molecules to result in an effluent (14). Further, the process also includes a distillation step for separating out the plurality of ultra-low aromatic chemicals from the effluent (14).

In one embodiment, the present invention discloses that Feedstock-1 (1), comprises hydrocarbon streams boiling between 90° C. and 370° C., is subjected to hydro-treatment in a hydro-treating reactor system (Reactor-1) in presence of hydrogen and hydro-treating catalyst system known in the art. Also, it is further disclosed that the resulting reactor effluent is low in sulphur as well as aromatic content as compared to Feedstock-1 (1).

In the detailed embodiment, the present invention discloses that the boiling range of Feedstock-1 (1) is between 90° C. and 370° C., preferably between 85° C. and 340° C. and most preferably between 80° C. and 320° C. The Feedstock-1 (1) comprises hydrocarbon streams; the hydrocarbon streams may be either obtained from atmospheric distillation unit or catalytic/thermal cracking unit (i.e., fluid catalytic cracking unit (FCC)/delayed coker unit (DCU)) or hydro-cracking unit or a mixture thereof. The hydrocarbon streams obtained from crude oil distillation unit is referred as "straight run streams" whereas the streams obtained from catalytic/thermal cracking unit are referred as "cracked streams". It may be noted that the aromatic content of the cracked streams is significantly higher as compared to the straight run streams; accordingly, the operating severity of Reactor-1 is optimized depending on the proportion of the cracked stream in Feedstock-1 (1).

The aromatic content of Feedstock-1 (1) is preferably between 20 wt % and 50 wt %, more preferably between 20-40 wt % and most preferably between 25-40 wt %. The sulfur content in Feedstock-1 (1) is between 0.5-2 wt %, more preferably 0.5-1.5 wt % and most preferably 0.5 wt % and 1 wt %. It is further disclosed that for production of high flash and high viscous specialty solvents/chemicals the lighter boiling component i.e., 80° C.-160° C., more preferably 80° C.-180° C. is preferably less than 60 wt %, more preferably less than 50 wt % and most preferably less than 30 wt % as this will affect the yield of high flash and high viscous grade specialty solvents/chemicals.

The catalyst system for Reactor-1 should have both desulfurization and hydrogenation function. The Reactor-1 catalyst system comprises at least one Group VI metal, preferably molybdenum and at least one Group VIII metal, preferably nickel on alumina or any other material having high or at least same surface area and stability as alumina.

The system for producing multiple grades of ultra-low aromatic chemicals from a plurality of low value hydrocarbon streams includes at least two reactor units (A, C) for hydrotreating a plurality of hydrocarbon feedstocks in the presence of a hydrogen gas stream and a hydrotreating catalyst system. The at least two reactor units includes a first reactor unit (A) hereinafter referred as "Reactor-1" and a second reactor unit (C) hereinafter referred as "Reactor-2". The system further includes at least one stripper unit (B) placed in between the at least two reactor units for stripping out at least one dissolved gas from the hydrotreated hydrocarbon feedstocks. Further, the system also includes at least one adsorption unit (D) for a selective adsorption, or a selective desorption of at least one molecule from the hydrotreated hydrocarbon feedstock, wherein, a temperature for the selective adsorption is between 35-120° C., and a temperature for the selective desorption is 200-300° C. The system further includes at least one distillation unit (E) for fractional distillation of the hydrotreated hydrocarbon feedstocks.

The Weighted Average Bed Temperature (WABT) for Reactor-1 is preferably between 150° C. and 400° C., more preferably between 200° C. and 370° C. and most preferably between 250° C. and 350° C. The hydrogen partial pressure is between 10 bar g and 120 bar g, more preferably between 30-90 bar g and most preferably between 35-75 bar g. The liquid hourly space velocity (LHSV) is maintained in the range of 0.5-5 h−1, more preferably 0.5-2.5 h−1 and most preferably 0.5-1.5 h−1. Depending upon the feed rate, catalyst volume and reactor dimension, the Reactor-1 may comprise a single or multiple reactor system. The Gas to oil ratio for Reactor-1 is in the range of 50-1200 Nm3/m3, more preferably 200-1000 Nm3/m3 and most preferably 300-800 Nm3/m3. For maintaining WABT in Reactor-1, provision for either gaseous or liquid quench as known in the art is provided. The gaseous quench comprises a mixture of gases with H2 concentration more than 90 vol. %, more preferably 92 vol. % and most preferably 95 vol. %. In case if liquid quench is provided, Feedstock-2 (7) or mixture of Feedstock-1 (1) and Feedstock-2 (7) can be used for quenching purpose. In one of the embodiments, it is also disclosed that effluent of Reactor-1 (Effluent-1) or Stripper bottom or effluent of Reactor-2 (Effluent-2) or any stream of final products may also be used as liquid quench.

In another embodiment related to Reactor-1, it is disclosed that the operating severity is controlled in Reactor-1 so that the sulphur content in Effluent-1 is in the range 0-50 ppmw, more preferably in the range 0-20 ppmw and most preferably between 0-5 ppmw. The aromatic content in Effluent-1 is preferably below 25 wt %, more preferably below 15 wt % and most preferably below 7 wt %. The benzene content in the Effluent-1 is preferably below 500 ppmw, more preferably below 100 ppmw and most preferably below 50 ppmw.

In another embodiment, the present invention discloses that deep desulfurization and dearomatization in Reactor-1, leads to an increase in lighter fraction in the Effluent-1. The lighter fractions generate in Reactor-1 have boiling range often between 34° C. and 100° C., more often between 34° C. and 90° C. and most often between 34° C. and 75° C. The lighter fractions have very limited use as specialty solvent/chemicals in the industries. In order to limit the generation of lighter fractions in Reactor-1, nitrogen compounds are doped in Feedstock-1 (1). The nitrogen compounds are preferably selected from the class of amine compounds which decompose at reaction condition to generate ammonia (NH3). The ammonia suppresses the side chain chopping reaction during desulfurization and dearomatization reactions and thereby reduces generation of lighter fractions. The concentration of ammonia in gas-phase in Reactor-1 is maintained between 50 ppmw and 500 ppmw, more preferably between 50 ppmw and 250 ppmw and most preferably between 50 ppmw and 100 ppmw. In the same embodiment it is further disclosed that doping of nitrogen compounds in Feedstock-1 (1) reduces lighter fraction generation by 20-30%, more preferably between 30-50% and most preferably between 50-70%. It is further disclosed that excess doping of nitrogen compounds also affects desulfurization reaction adversely. In the same incarnation it is also calcified that the support for the catalyst system for Reactor-1 is preferably alumina and does not have any inherent acidity (Lewis or Bronsted). However, in the reaction condition during deep desulfurization and dearomatization mild acidity may develop temporarily leading to generation of lighter fraction in Effluent-1, which will be suppressed in presence of ammonia.

In another embodiment, it is disclosed that the effluent of Reactor-1 (Effluent-1) is sent to stripper for stripping out dissolved H2S. The H2S content in stripper bottom is preferably below 0.2 ppmw, more preferably below 0.1 ppmw and most preferably below 0.05 ppmw. The steam is used for stripping purpose in the stripper.

In another embodiment, it is disclosed that the stripper bottom is combined with Feedstock-2 (7), and called combined stream-1, prior to feeding in Reactor-2. The Feedstock-2 (7) comprises hydrocarbon stream from hydrocracker unit or diesel hydrotreater unit (DHDS) or mixtures thereof. The boiling rage of Feedstock-2 (7) is preferably between 100° C. and 250° C., and more preferably between 120 and 240° C., and most preferably between 140° C. and 220° C. In the same embodiment it is further disclosed that the sulphur and aromatic content of Feedstock-2 (7) is lower or at least in the similar range of Effluent-1. The hydrocarbon streams of hydrocracker unit or DHDT unit or mixtures thereof are selected because of higher iso-paraffinic and naphthenic content compared to Feedstock-1 (1). The iso-paraffin in Feedstock-2 (7) is preferably between 50 wt % and 80 wt %, more between 60 wt % and 75 wt %, and most preferably between 65 wt % and 70 wt %. The naphthenic content in Feedstock-2 (7) is between 20 wt % and 50 wt %, more preferably between 20 wt % and 40 wt % and most preferably between 25 wt % and 35 wt %.

In yet another embodiment, it is disclosed that the resulted combined Stream-1 (mixture of Effluent-1 and Feedstock-2) thus formed has aromatic content less than 25 wt %, more preferably 15 wt % and most preferably 5 wt %. In the same embodiment it is further disclosed that sulphur content of the combined stream is less than 2 ppmw, more preferably 1 ppmw and most preferably 0.5 ppmw. The benzene content of this stream is preferably below 500 ppmw, more preferably below 250 ppmw and most preferably below 100 ppmw.

In another embodiment, it is disclosed that the combined stream is sent to Reactor-2. The Reactor-2 catalyst system has high hydrogenation activity and the primary objective is aromatic saturation. The catalyst system is either Nickel (Ni) based or noble metal (Pd/Pt) based or combination thereof and selected from the catalyst portfolio known in the art.

The WABT for Reactor-2 is preferably between 90° C. and 350° C., more preferably between 130° C. and 300° C., and most preferably between 150° C. and 250° C. The hydrogen partial pressure is between 5 bar g and 75 bar g, more preferably between 15-70 bar g and most preferably between 25-65 bar g. The liquid hourly space velocity (LHSV) is maintained in the range of 0.2-5 h−1, more preferably 0.2-2.5 h−1 and most preferably 0.2-1.5 h−1. Depending upon the feed rate, catalyst volume and reactor dimension the Reactor-2 may comprise a single or multiple reactor system. The gas to oil ratio for Reactor-2 is in the range of 50-1200 Nm3/m3, more preferably 200-1000 Nm3/m3 and most preferably 250-900 Nm3/m3. For maintaining WABT in Reactor-2, provision for either gaseous or liquid quench as known in the art is provided. The gaseous quench comprises mixture of gases with H2 concentration more than 90 Vol %, more preferably 92 vol % and most preferably 95 vol %. The H2S concentration in the quench gas is preferably below 0.5 ppmw, and most preferably 0.05 ppmw. In case if liquid quench is provided, Feedstock-3 (12) or mixture of Feedstock-2 (7) and Feedstock-3 (12) can be used for quenching purpose. In one of the embodiments, it is also disclosed that effluent of Reactor-2 (Effluent-2) or adsorption unit effluent or any stream of final products can be also used for quench purpose.

In another embodiment related to Reactor-2, it is disclosed that the aromatic content in Effluent-2 is preferably below 5 wt %, more preferably below 1 wt % and most preferably below 0.5 wt %. The benzene content in the Effluent-1 is preferably below 100 ppmw, more preferably below 50 ppmw and most preferably below 5 ppmw.

Figure 3:
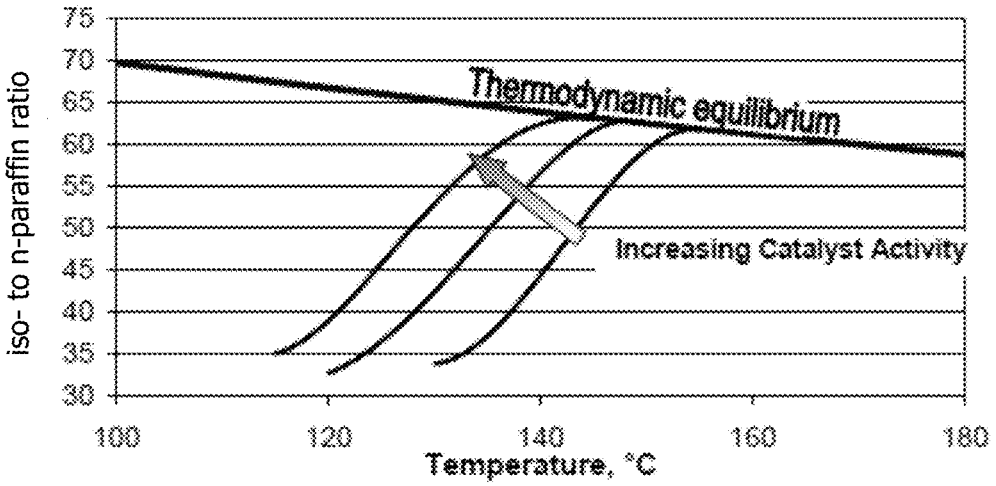
FIG. 3: illustrates a graph between iso to n-paraffin ratio v/s temperature.

In one embodiment it is disclosed that the operating condition, particularly, WABT in Reactor-2 is so maintained that it favors dearomatization reaction as well as preserves iso-paraffin molecules present in the Feedstock-2. It is well known in the art that isomerization reactions are mildly exothermic and equilibrium between iso-paraffin and n-paraffin is favorable towards iso-paraffin at lower temperature (FIG. 3), therefore, in Reactor-2, the operating conditions are controlled in such a way (by varying catalyst type and metal, catalyst volume and activity, feed rate, operating temperature condition, operating pressure condition, etc.) that favors the isomerization, if any. Further, as explained in previous paragraphs, iso-paraffin molecules have better solvency effect compared to n-paraffin, hence, Feedstock-2 is purposefully introduced in Reactor-2 to avoid adverse effect on equilibrium in Reactor-2. It is further disclosed that since the catalyst system chosen for Reactor-2 is capable of performing deep hydrodesulfurization and dearomatization reactions under the operating conditions explained hereinabove in addition to the thermodynamics (operating temperature and pressure) and is the additional tool only for preserving the iso-paraffin compounds in the product.

In another embodiment, it is disclosed that the Effluent-2 is mixed with Feedstock-3 (12), and called combined Stream-2, and sent to adsorption unit. The Feedstock-3 (12) comprises hydrocarbon stream from hydrocracker unit or isomerization unit or alkylation unit or mixtures thereof. The boiling range of Feedstock-3 (12) is between 65° C. and 160° C., more preferably between 70° C. and 140° C. and most preferably between 85° C. and 120° C. In the same embodiment it is also disclosed that the sulphur content in Feedstock-3 (12) is below 5 ppmw, more preferably 2 ppmw and most preferably 0.5 ppmw. The aromatic content is preferably below 0.5 wt %, more preferably 0.1 wt % and most preferably 0.05 wt %. It is further disclosed that the Feedstock-3 (12) is preferably rich in iso-paraffin molecules. The iso-paraffin content of Feedstock-3 (12) is in the range of 50-80%, more preferably 60-75% and most preferably 65-70%.

In yet another embodiment, it is disclosed that operating severity of the adsorption step is controlled in such a way (by varying catalyst volume and activity, feed rate, operating temperature, pressure, etc.) that the resulted combined stream thus formed has aromatic content less than 3 wt %, more preferably 0.8 wt % and most preferably 0.3 wt %. In the same embodiment, it is further disclosed that sulphur content of the combined stream is less than 2 ppmw, more preferably 1 ppmw and most preferably 0.5 ppmw. The benzene content of this stream is preferably below 70 ppmw, more preferably below 30 ppmw and most preferably below 5 ppmw.

In one of the embodiments, it is disclosed that the combined Stream-2 (mixture of Effluent-2 and Feedstock-3) is routed to adsorption unit. The adsorption unit may constitute of multiple adsorption reactors loaded with adsorbents depending on the final aromatic concentrations required in the product streams. The adsorbents are the zeolite based molecular sieves known in the art. The adsorbents selectively adsorb the molecules in the combined feed stream based on the difference in polarity. In the adsorbent reactor, the retention times of the different molecules are different. The aromatic molecules because of their polar nature have the highest retention time compared to the saturated molecules. The adsorption reactors are operated in cycles. In the adsorption unit some reactors are in adsorption stages while the others are in desorption/regeneration stage; hence, the product rates are continuous from the adsorption unit. Desorption/regeneration of absorbents is done by the hot fuel gas or any other inert gas. The temperature maintained during adsorption stage is preferably between 35° C. and 120° C., while desorption is done at 200-300° C. The effluent from adsorption unit is sent to distillation unit for fractionation purpose.

In one embodiment, it is disclosed that the operating severity of the adsorption step is controlled in such a way (by varying adsorbent volume, feed rate, operating temperature, pressure, etc.) that effluent from adsorption unit contains aromatics less than 300 ppmw, more preferably less than 100 ppmw and most preferably less than 30 ppmw. In the same embodiment, it is further disclosed that the benzene content is less than 0.5 ppmw, more preferably less than 0.1 ppmw and most preferably less than 0.01 ppmw.

In yet another embodiment, it is disclosed that effluent of adsorption unit is fractionated in a distillation column for producing multiple grade dearomatized solvents/chemical. It is further disclosed that boiling range and Flash point of dearomatized solvent are adjusted by distillation of the entire product stream obtained after adoption. As known in the art the specialty solvents/chemicals are classified based on either boiling range or flash point.

The broad classifications based on boiling points are:

Type-1 Solvent/Chemicals: Final Boiling Point (FBP) less than 185° C.

Type-2 Solvent/Chemicals: Initial Boiling Point (IBP) more than 185° C. ad FBP less than 260° C.

Type-3 Solvent/Chemicals: FBP more than 260° C.

The broad classifications based on the Flash point (FP) are:

Type-A Solvent/Chemicals: Low flash point solvents/chemicals (FP<50° C.)

Type-B Solvent/Chemicals: Medium flash point solvent/chemicals (FP>50° C. and <90)

Type-C Solvent/Chemicals: High flash point solvents/chemicals (FP>90° C.).

In another embodiment, it is disclosed that all the types of specialty solvents/chemicals discussed above can be produced by the configuration scheme disclosed in the present innovation. It is further disclosed that, the present scheme discusses only about the production of solvents based on the broad specifications discussed above, however, it not restricted to these solvents/chemicals only.

It is further disclosed that the distillation column may be single or multiple. The side stripper for each draw off product can be used for finer tuning of the boiling points and flash point.

The Type-1 solvent/chemicals are withdrawn from the top of the distillation column. The aromatics content in Type-1 solvent/chemical is preferably less than 30 ppm, more preferably less than 20 ppm, and most preferably less than 10 ppm. It is further, disclosed that the benzene content in Type-1 solvent is preferably less than 1 ppmw, more preferably less than 0.5 ppmw and most preferably less than 0.1. The Type-1 solvent/chemicals, contains isoparaffins higher than 60 wt %, more preferably 70 wt % and most preferably 80 wt %. In the same embodiment, it is further disclosed that boiling range of the Type-1 solvent is also adjusted to meet the flash criteria of Type-A solvents/chemicals. The Type-1/Type-A solvent finds applications high in cosmetic, pharmaceutical, hand soaps, aerosols, thinners for paints and resins.

The middle cut obtains from the distillation column meets Type-2 solvents/chemicals specification. The aromatic content in Type-2 solvents/chemicals is preferably less than 100 ppm, more preferably less than 50 ppm and most preferably less than 30 ppm. This product contains naphthenes higher than 60 wt %, more preferably 70 wt % and most preferably 80 wt %. In the same embodiment, it is further disclosed that boiling range of the Type-2 solvent is also adjusted to meet the flash criteria of Type-B solvents/chemicals. Type-2/Type-B solvents finds applications in polyolefin synthesis, drilling fluids, metal working fluids, aluminum rolling oils, ink industries, silicon sealants, viscosity depressants for PVC, explosives, transmission fluids, concrete demoulding, paints and decorative coatings.

The Type-3 solvents/chemicals are obtained from the bottom of distillation column. The aromatic content in Type-3 solvents/chemicals is preferably less than 500 ppm, more preferably less than 300 ppm and most preferably less than 150 ppm. In the same embodiment, it is further disclosed that boiling range of the Type-3 solvent is also adjusted to meet the flash criteria of Type-C solvents/chemicals. The Type-3/Type-C solvents/chemicals finds application in crop protection fluids, polymeric composition used in mining operation, water treatment, paper manufacture, drilling fluids, metal working fluids, aluminum rolling oils, ink industries, silicon sealants, viscosity depressants for PVC, explosives, transmission fluids, concrete demoulding, paints and decorative coatings and pharmaceutical applications.

In one embodiment, it is further disclosed that a part of Feedstock-3 (12) can be also blended with top cut of distillation column without changing the aromatic and benzene concentration of Type-1/Type-A solvents. The Feedstock-2 (7) can be also blended directly with middle and bottom cut of distillation column without changing the aromatic, benzene, flash point and viscosity of the Type-2/Type-B and Type-3/Type-3 solvents/chemicals respectively. Similarly many other obvious variations in the processing scheme and configurations are possible and whatever the configurations are disclosed in the present invention is just an illustration of the spirit of the idea.

EXAMPLES

Example-1

Feedstock-D doped with tert-butylamine is hydrotreated at 360° C. WABT and 75 bar g H2 partial pressure in presence of Ni—Co—Mo Catalyst system. The other operating parameters i.e., LHSV and H2/HC ratio are maintained similar to any commercial hydrotreating unit. The reactor effluent is stripped offline to remove dissolved H2S. The characterization of Feedstock-D and stripped hydrotreater effluent (Effluent-1) are given in Table 1.

Further, the Effluent-1 is mixed with Feedstock-E to generate combined stream-1. The combined stream-1 is hydrotreated at 30 bar g pressure, 250° C. WABT and 1.5 h−1 LHSV in presence of Ni-Based catalyst system. The H2/HC ratio has been maintained in the range 250-0700 Nm3/m3. The detailed characterization of Feedstock-E, combined stream-1 and hydrotreated effluent (Effluent-2) are given in Table 2.

The Intermediate-2 is further combined with Feedstock-F to generate combined stream-2 (Table-3). This combined stream-2 is subjected to adsorption at ambient temperature and 10 bar g H2 partial pressure. The effluent from adsorption unit is fractionated into 3 different cuts. The Properties of Cut-1, Cut-2 and Cut-3 are shown in Table 4.

TABLE 1

Properties of Feedstock D and Effluent-1

| S. No. | Property | Feedstock D | Effluent-1 |
|---|---|---|---|
| 1. | Sulfur (wt %/ppmw) | 1 | <10 |
| 2. | Boiling range (° C.) -ASTM D 2887 | 140-320 | 135-240 |
| 3. | Nitrogen (ppmw) | 25 | <0.5 |
| 4. | Aromatics (wt %) - by HPLC | 37 | 15 |
| 5. | Density (g/cc) | 0.8011 | 0.7998 |
| 6. | Naphthenes (wt %) - by NMR | 20 | 35 |
| 7. | Benzene (ppmw) - by GC | 80 | 22 |

TABLE 2

Properties of Feedstock-E, Combined stream-1 and Effluent-2

| S. No. | Property | Feedstock-E | Combined stream-1 | Effluent-2 |
|---|---|---|---|---|
| 1. | Sulfur (ppmw) | <0.5 | <0.5 | <0.5 |
| 2. | Boiling range (° C.) - ASTM D 2887 | 140-240 | 130-320 | 125-320 |
| 3. | Nitrogen (ppmw) | <0.5 | <0.5 | <0.5 |
| 4. | Aromatics (wt %) - By HPLC and UV | 5 | 13 | 0.1 |
| 5. | Density (g/cc) | 0.835 | 0.832 | 0.831 |
| 6. | Naphthenes (wt %) - by NMR | 75.6 | 60 | 83 |
| 7. | Benzene (ppmw) - by GC | 50 | 100 | <1 |

TABLE 3

Properties of Feedstock-F, Combined stream-2

| S. No. | Property | Feedstock-F | Combined stream-2 |
|---|---|---|---|
| 1. | Sulfur (ppmw) | <0.5 | <0.5 |
| 2. | Boiling range (° C.) | 90-140 | 90-320 |
| 3. | Nitrogen (ppmw) | <0.5 | <0.5 |
| 4. | Aromatics (wt %) by UV | 0.05 | 0.5 |
| 5. | Density (g/cc) | 0.776 | 0.829 |
| 6. | Naphthenes (wt %) - by NMR | 20 | 70 |
| 7. | Benzene (ppmw) - by GC | 3 | 20 |
| 8. | Iso-paraffin (wt %) -by NMR | 80 | 28 |

TABLE 4

Properties of cuts

| S. No. | Properties | Cut-1 | Cut-2 | Cut-3 |
|---|---|---|---|---|
| 1. | Sulfur (ppmw) | <0.5 | <0.5 | <0.5 |
| 2. | Boiling range (° C.) | 90-185 | 186-260 | 261-320 |
| 3. | Aromatics (ppmw) - by UV | 12 | 22 | 29 |
| 4. | Benzene (ppmw) - by GC | <1 | <1 | <1 |
| 5. | Flash point (° C.) | <50 | 85 | >90 |
| 6. | Iso-paraffin (wt %) - by NMR | 65 | 15 | 10 |
| 7. | Naphthene (wt %) - by NMR | 35 | 75 | 90 |

Example-2

In continuation with Example-1, a part of Feedstock-F (30%) is combined with Cut-1 and the rest 70% is mixed with Effluent-2 to form the combined stream-2. The combined stream-Y is then subjected to adsorption and then fractionated to generate 3 cuts. The properties of combined stream-Y and the 3 cuts are given in Table 5.

TABLE 5

Properties of combined streams and the cuts generated

| S. No. | Property | Combined stream-Y | Cut-1 | Cut-2 | Cut-3 |
|---|---|---|---|---|---|
| 1. | Sulfur (ppmw) | <0.5 | <0.5 | <0.5 | <0.5 |
| 2. | Boiling range (° C.) | 90-320 | 90-185 | 186-260 | 261-320 |
| 3. | Nitrogen (ppmw) | <0.5 | <0.5 | <0.5 | <0.5 |
| 4. | Aromatics (wt %/ppmw) by UV | 0.5 | 12 | 22 | 29 |
| 5. | Density (g/cc) | 0.859 | — | — | — |
| 6. | Naphthenes (wt %) - by NMR | 70 | 28 | 78 | 90 |
| 7. | Benzene (ppmw) - by GC | 20 | <1 | <1 | <1 |
| 8. | Iso-paraffin (wt %) - by NMR | 28 | 72 | 12 | 10 |

Example-3

In this example the effect of amine doping in Reactor-1 has been illustrated by hydrotreating Feedstock-D without (Case-1) and with (Case-2) amine (tert-butylamine) doping at 360° C. WABT and 75 bar g $H_2$ partial pressure in presence of Ni—Co—Mo Catalyst system. The other operating parameters i.e., LHSV and H2/HC ratio are maintained similar to any commercial hydrotreating unit. The characterizations of Feedstock-D along with effluent generated in two cases are given in Table 6.

TABLE 6

Characterizations of Feedstock-D and effluent of Case-1 and Case-2

| S. No. | Property | Feedstock D | Case-1 (without amine doping) | Case-2 (with amine doping) |
|---|---|---|---|---|
| 1. | Sp. Gravity | | | |
| 2. | Sulfur (wt %/ppmw) | 1 | 8 | 5 |
| 3. | Nitrogen (ppmw) | | <0.5 | <0.5 |
| 4. | Boiling range (° C.) - ASTM D 2887 | | | |
| | IBP | 90 | 33 | 85 |
| | 10% | 120 | 75 | 119 |
| | 30% | 140 | 112 | 140 |
| | 50% | 200 | 180 | 200 |
| | 90% | 290 | 270 | 290 |
| | FBP | 320 | 320 | 320 |

The invention claimed is:

1. A process for producing a plurality of ultra-low aromatic chemicals from a plurality of low value hydrocarbon streams, the process comprising:

subjecting a hydrocarbon feedstock-1 to a first hydrotreating in a first reactor unit, wherein the hydrocarbon feedstock-1 is doped with 50-500 ppmw of a nitrogen compound, wherein the first reactor unit is loaded with a dual functional catalyst system, wherein the dual functional catalyst system is capable of desulfurization and hydrogenation, wherein the first hydrotreating provides a first effluent; wherein sulphur content in the first effluent is below 2 ppmw;

maintaining a Weighted Average Bed Temperature (WABT) between 250° C. and 350° C., a hydrogen partial pressure between 35-75 bar g, a liquid hourly space velocity (LHSV) in a range of $0.5\text{-}1.5^{-1}$, a gas to oil ratio in a range of 300-800 $Nm^3/m^3$ in the first reactor unit;

stripping the first effluent in at least one stripper unit to remove at least one dissolved gas from the first effluent to provide a stripper effluent, wherein $H_2S$ content in the stripper effluent is below 0.05 ppmw;

mixing the stripper effluent with a hydrocarbon feedstock-2 to form a combined stream-1, wherein the hydrocarbon feedstock-2 has a boiling range between 100° C.-220° C., an iso-paraffin content between 50 wt %-80 wt %, and a naphthenic content between 20 wt %-50 wt %, wherein, sulphur and aromatic content of the hydrocarbon feedstock-2 is lower than the sulphur and aromatic content of the first effluent;

subjecting the combined stream-1 to a second hydrotreating in a second reactor unit, wherein the second reactor unit is loaded with a hydrogenation catalyst system having aromatic saturation properties, wherein the second hydrotreating provides a second effluent;

maintaining a WABT between 150° C. and 250° C., a hydrogen partial pressure between 25-65 bar g, an LHSV in a range of $0.2\text{-}1.5^{-h}$, a gas to oil ratio in a range of 250-900 $Nm^3/m^3$ in the second reactor unit;

mixing the second effluent of the second reactor with Feedstock-3 to form a combined stream-2, wherein the hydrocarbon Feedstock-3 has a boiling range between 65° C.-160° C., an iso-paraffin content between 50 wt %-80 wt %, wherein, sulphur and aromatic content of the hydrocarbon Feedstock-3 is lower than the second effluent;

subjecting the combined stream-2 to an adsorption unit, wherein the aromatic molecules are selectively adsorbed from the combined stream-2 enriching it with paraffin, iso-paraffin and naphthenic molecules wherein the selective adsorption is based on a difference in a polarity of molecules to result in a third effluent from the adsorption unit;

subjecting the third effluent from the adsorption unit to a distillation unit to separate out the plurality of ultra-low aromatic chemicals from the third effluent by distillation.

2. The process as claimed in claim 1, wherein the first and the second hydrotreating convert aromatic molecules into naphthene molecules.

3. The process as claimed in claim 1, wherein:

the first hydrotreating comprises hydrotreating the hydrocarbon feedstock-1 having a boiling temperature between 90° C.-370° C., an aromatic content between 20 wt %-50 wt %, and a sulfur content between 0.5-2 wt %, and wherein the first effluent comprises an aromatic content below 25 wt % and benzene content below 500 ppmw.

4. The process as claimed in claim 1, wherein the dual functional catalyst system comprises active metals selected from Molybdenum (Mo), Nickel (Ni), or a combination thereof, wherein the active metals are impregnated on an alumina support.

5. The process as claimed in claim 1, wherein:

the stripping removes dissolved $H_2S$ gas from the first effluent by steam, thereby resulting into the stripper effluent having $H_2S$ content below 0.2 ppmw, wherein the stripper effluent is subjected to the second hydrotreating along with the hydrocarbon feedstock-2, and wherein the second effluent comprises an aromatic content below 5 wt % and benzene content below 100 ppmw.

6. The process as claimed in claim 1, wherein the hydrogenation catalyst system comprises active metals selected from Nickel (Ni), Palladium (Pd), Platinum (Pt) or a combination thereof, wherein the active metals are impregnated on a support.

7. The process as claimed in claim 1, further comprising:

wherein the hydrocarbon feedstock-3 has an aromatic content less than 0.5 wt %, a sulphur content less than 5 ppmw and an iso-paraffin content in a range of 50-80%.

8. The process as claimed in claim 1, wherein the third effluent has an aromatic content less than 300 ppmw, benzene content below 0.5 ppmw.

* * * * *